US010881972B2

(12) United States Patent
Mayfield

(10) Patent No.: US 10,881,972 B2
(45) Date of Patent: Jan. 5, 2021

(54) UNDERWATER PARK RIDE SYSTEM

(71) Applicant: Sub Sea Systems, Inc., Diamond Springs, CA (US)

(72) Inventor: Jim Ryan Mayfield, Diamond Springs, CA (US)

(73) Assignee: Sub Sea Systems, Inc., Diamond Springs, CA (US)

( * ) Notice: Subject to any disclaimer, the term of this patent is extended or adjusted under 35 U.S.C. 154(b) by 0 days.

(21) Appl. No.: 16/097,203

(22) PCT Filed: Apr. 27, 2017

(86) PCT No.: PCT/US2017/029965
§ 371 (c)(1),
(2) Date: Oct. 26, 2018

(87) PCT Pub. No.: WO2017/189924
PCT Pub. Date: Nov. 2, 2017

(65) Prior Publication Data

US 2019/0134514 A1 May 9, 2019

Related U.S. Application Data

(60) Provisional application No. 62/328,576, filed on Apr. 27, 2016.

(51) Int. Cl.
*A63G 3/06* (2006.01)
*A63H 23/04* (2006.01)

(52) U.S. Cl.
CPC ..... *A63G 3/06* (2013.01)

(58) Field of Classification Search
CPC ..... A63G 21/00; A63G 21/18; A63G 31/00; A63G 31/007; A63B 2225/60; A63B 5/10
USPC ..... 472/13, 117, 128, 129, 134; 446/153, 446/160–164
See application file for complete search history.

(56) References Cited

U.S. PATENT DOCUMENTS 3,114,333 A * 12/1963 Fowler ..... A63G 31/16 104/71
5,215,016 A * 6/1993 Futami ..... A63G 3/06 104/247
5,775,226 A * 7/1998 Futami ..... B63G 8/001 104/71
6,007,402 A * 12/1999 Nelson, II ..... A63H 29/14 446/153
6,066,049 A * 5/2000 Milanian ..... A63G 3/06 472/128
7,854,663 B2 * 12/2010 Burger ..... A63G 3/02 114/61.1

(Continued)

OTHER PUBLICATIONS

Patent Cooperation Treaty International Search Report dated Aug. 7, 2017.

(Continued)

*Primary Examiner* — Kien T Nguyen

(57) ABSTRACT

The disclosure is directed to an underwater park ride system that includes a track having a plurality of air registers embedded within the track for discharging compressed air. The underwater park ride system further includes an underwater vehicle having an air engine that is configured to collect the discharged compressed air in a manner that propels the underwater vehicle along the track.

23 Claims, 15 Drawing Sheets

(56) References Cited

U.S. PATENT DOCUMENTS

| | | | | |
|---|---|---|---|---|
| 8,210,955 | B2 * | 7/2012 | Yule | A63G 21/18<br>104/23.2 |
| 2011/0076910 | A1 * | 3/2011 | Johnston | A63H 23/04<br>446/163 |
| 2013/0324003 | A1 * | 12/2013 | Hippely | A63H 18/02<br>446/153 |

OTHER PUBLICATIONS

The International Search Report from the underlying parent PCT application PCT/US2017/029965 is cited and attached concurrently with the filing of the U.S. national stage utility patent application dated Oct. 26, 2018.

* cited by examiner

UNDERWATER PARK RIDE SYSTEM

CROSS-REFERENCE TO RELATED APPLICATIONS

This document is a national stage entry, application, claiming the benefit of, and priority through, International Patent Application No. PCT/US2017/029965, filed on Apr. 27, 2017, entitled "Underwater Park Ride System," under 35 U.S.C. § 371, in turns, claiming the benefit of, and priority to U.S. Provisional Patent Application Ser. No. 62/328,576, filed Apr. 27, 2016, entitled "Aquaticar," under 35 U.S.C. 119(e), all of which are hereby incorporated by reference herein in their entirety.

BACKGROUND

Theme parks attract millions of tourists from all over the world. Each theme park attempts to outdo the other theme parks by introducing fresh attractions, new characters, new films, new rides, and new promotions. However, most of the new additions are just variations of current attractions.

SUMMARY

Embodiments of the disclosure are directed towards an underwater park ride system. The underwater park ride system includes a track having a plurality of air registers embedded within the track for discharging compressed air. The system further includes an underwater vehicle having an air driven engine that is configured to collect the discharged compressed air in a manner that utilizes the uplift force of bubbles to propels the underwater vehicle along the track.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The following disclosure describes an underwater park ride system that may be an attraction at a water or theme park. The underwater park ride system includes an underwater vehicle propelled forward by using an air engine powered by bubble power. Because bubbles in liquid are in conflict with their environment, bubbles not only do not mix with the water, but they constantly try to escape from their environment. If this was not the case, bubbles would happily float about underwater. Instead, the water column presses inwardly on all sides of the bubbles attempting to crush the bubbles. This is why bubbles maintain the minimum surface area possible (i.e., a sphere). The "up thrust" of a bubble is equal to the weight of the fluid it displaces. Simply stated, a one-cubic foot container will generate 63 pounds of up thrust. The inventors of the present invention designed an ingenious engine that is driven by the power of bubbles and that powers a drive system on the world's first underwater vehicle, thereby providing an under water driving experience. During the underwater driving experience, guests encounter a variety of underwater features, drive-thru arches, tropical reefs, long lost artifacts, and the like. Instead of hewing mechanical conveyor systems, the guests hear a thumping sound as the bubbles are released from the air engine. As the air is released from the air engine, it is ducted directly into the passenger canopy, thereby feeding a continuous flow of fresh air for the guest to breathe.

Figure 1:
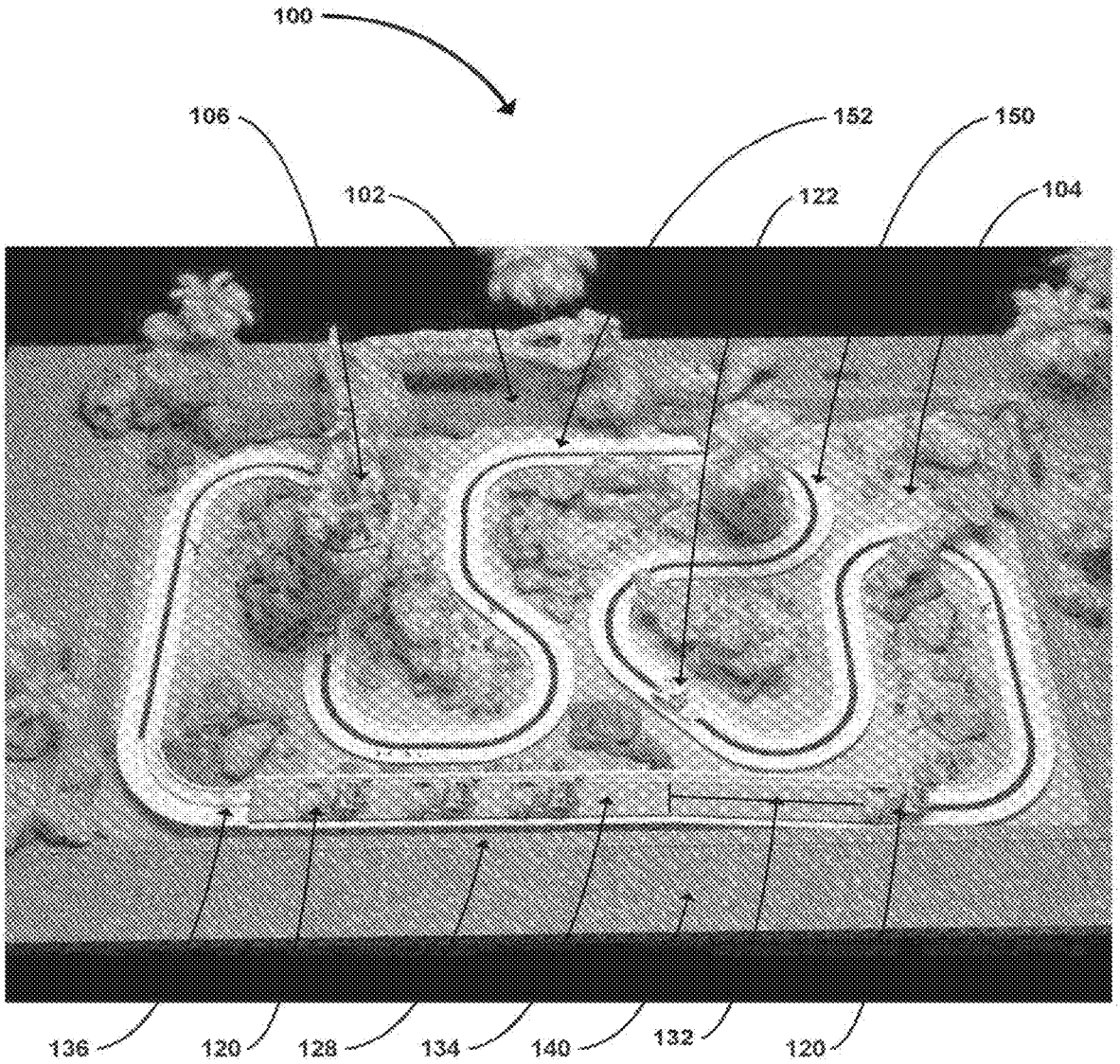
FIG. 1 is a conceptual overview of one embodiment of an underwater park ride system.

FIG. 1 is a conceptual overview of one embodiment of an underwater park ride system. The underwater park ride system 100 includes a pool 102 into which water 104 and themed features 106 (e.g., schooling fish, stingrays, arches, reefs, shipwrecks, and the like) are provided to simulate a realistic underwater experience. In some embodiments, the pool may measure one hundred feet wide by one hundred fifty feet long by approximately nine feet deep. The themed features in the pool 106 may be designed in a manner such as to represent any themed environment, such as the Lost City of Atlantis, a natural reef, a lunar landscape, futuristic features, or the like. The water 104 may be a fresh water environment, a thriving salt-water reef environment, and/or any other water environment.

The underwater park ride system 100 also includes one or more underwater vehicles (e.g., underwater vehicles 120, 122), an underwater course 150 made up of several tracks (e.g., track 152), and a guest platform 128. The guest platform 128 includes an ascending ramp 132, a moving sidewalk 134, and a descending ramp 136. The underwater vehicles 120, 122 ascend and descend from the water via the carousel 128. The underwater park ride system 100 further includes a guest platform 140 where guests load and unload from the underwater vehicles. The guest platform 128 is located in an area where the guests may remain relatively dry while they queue up for the underwater ride. In some embodiments, the underwater vehicles 120, 122 continually move forward on the moving sidewalk 134. The carousel may be configured in a manner such that the underwater vehicles move at a controlled speed so that guests have adequate time to load and unload. For example, in some embodiments, the moving sidewalk may be configured to travel at a slower speed to provide a set time period (e.g. 90 seconds) to unload and load guests for each vehicle. A mechanical transporting apparatus, described in more detail in conjunction with FIG. 12, drives the carousel and may be designed to move the underwater vehicles at a continuous pace around the carousel. The mechanical transporting apparatus begins the moment the underwater vehicle transitions onto the ascending ramp 132 and ends upon re-entry into the water after the descending ramp 136. As the underwater vehicle 120 ascends from the water on the ascending ramp 132 and onto the moving sidewalk 134, guests unload from the vehicle and other guests load into the underwater vehicle 120 from the guest platform 140. Once the new guests have loaded into their underwater vehicle, the moving sidewalk 134 delivers the underwater vehicle 120 onto the descending ramp 136 where gravity begins to take over and transports the underwater vehicle into the depths of the pool 102 and onto the underwater course 150 so the guests can enjoy their underwater driving experience.

Figure 8:
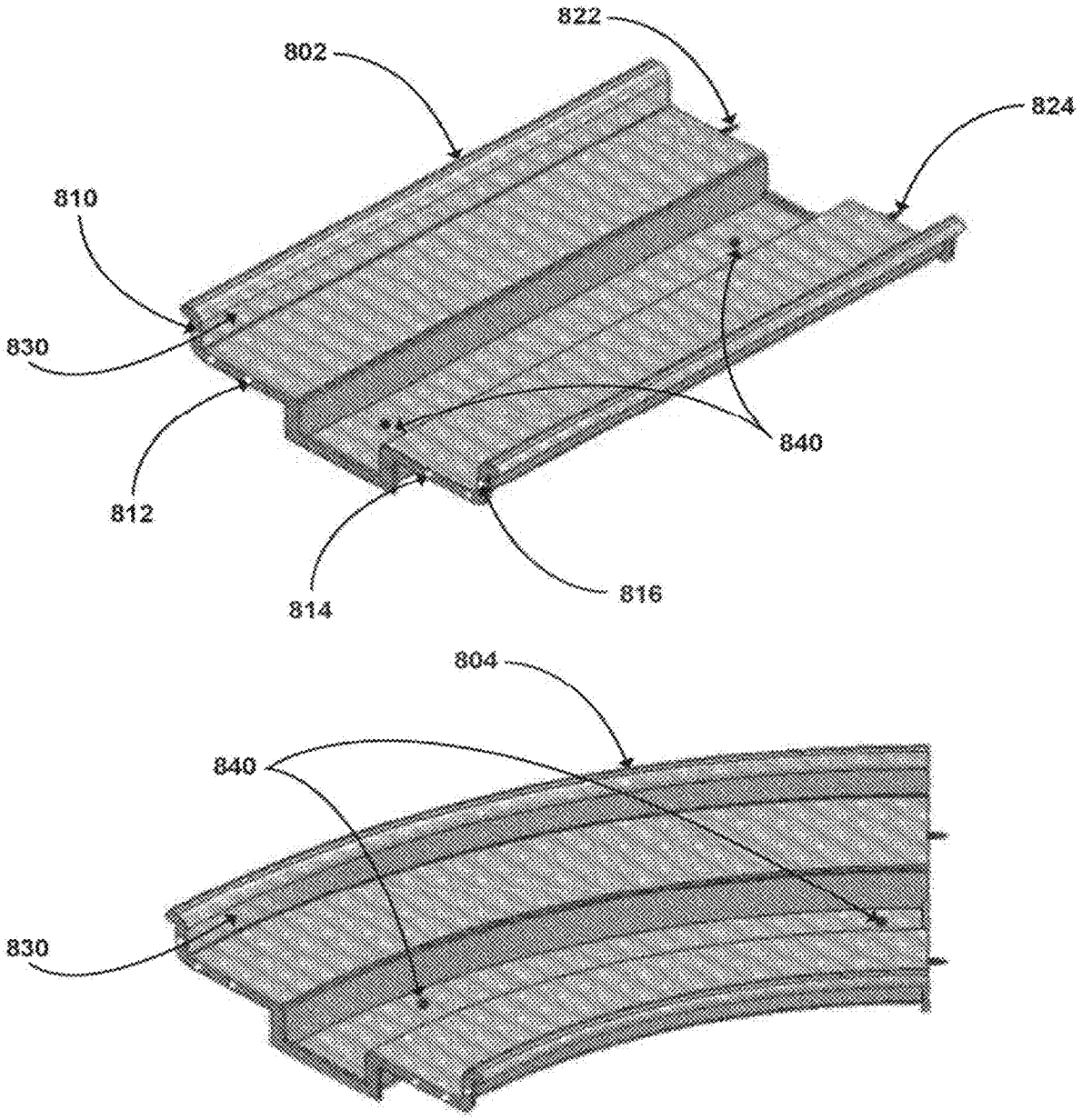
FIG. 8 is a view of one embodiment of interlocking underwater tracks which may be used in the underwater park ride system illustrated in FIG. 1.

The course 150 includes several tracks (e.g., track 152), described in more detail in conjunction with FIG. 8. The underwater vehicles 120, 122 move under the water via the underwater tracks 152 that are configured in a manner such that the underwater vehicles stay within the confines of the underwater track, while still providing the guests an underwater driving experience. The underwater vehicles drive along the course 150 over a series of air dispensers (not shown) embedded into the track 152 every few feet along the underwater course 150. The air dispensers emit air bubbles which are captured by the underwater vehicles to propel the vehicles forward along the course 150.

Figure 2:
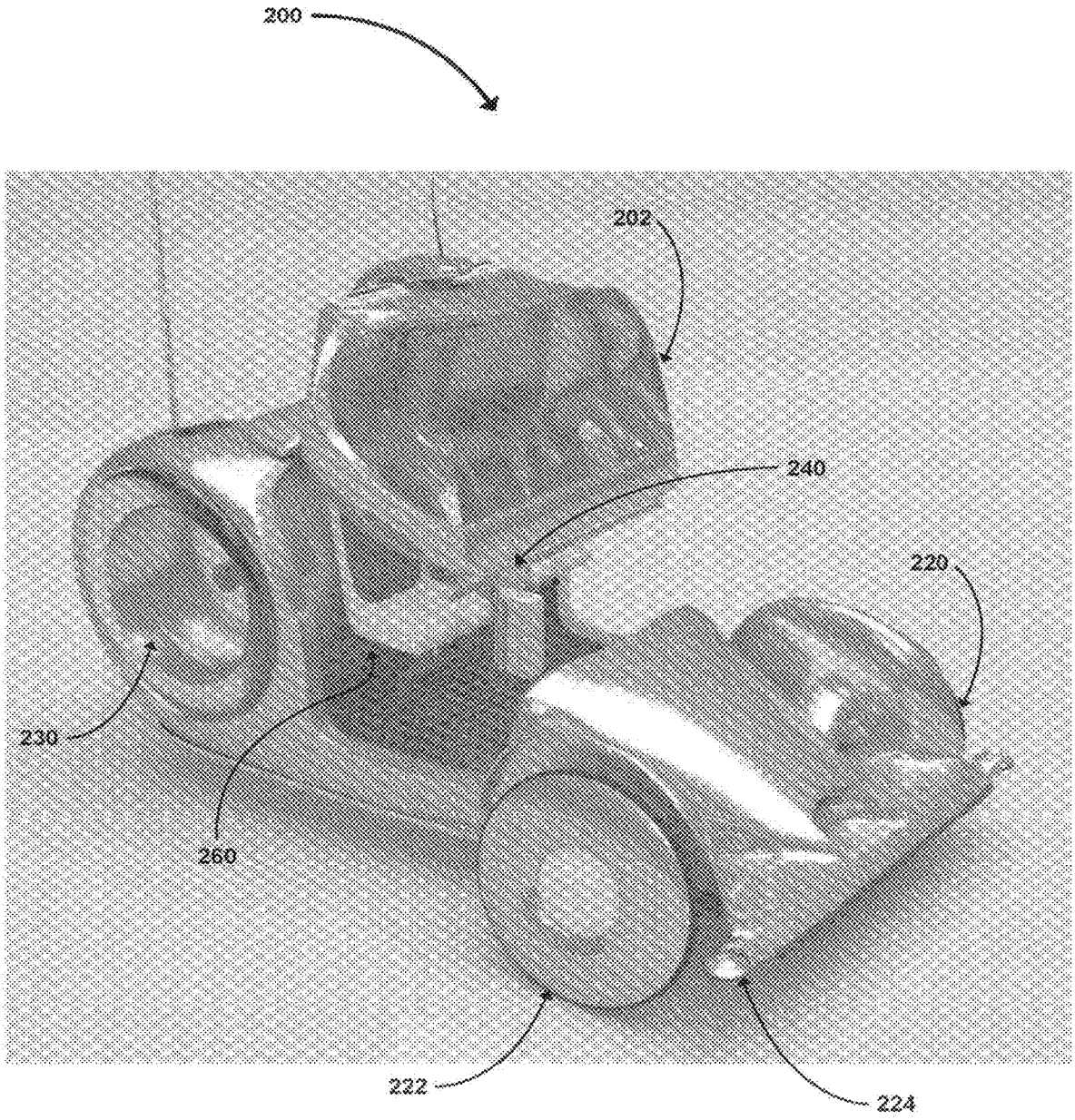
FIG. 2 is a view of one embodiment of an underwater vehicle which may be used in the underwater park ride system illustrated in FIG. 1 where a canopy of the underwater vehicle is shown in a closed position.
Figure 3:
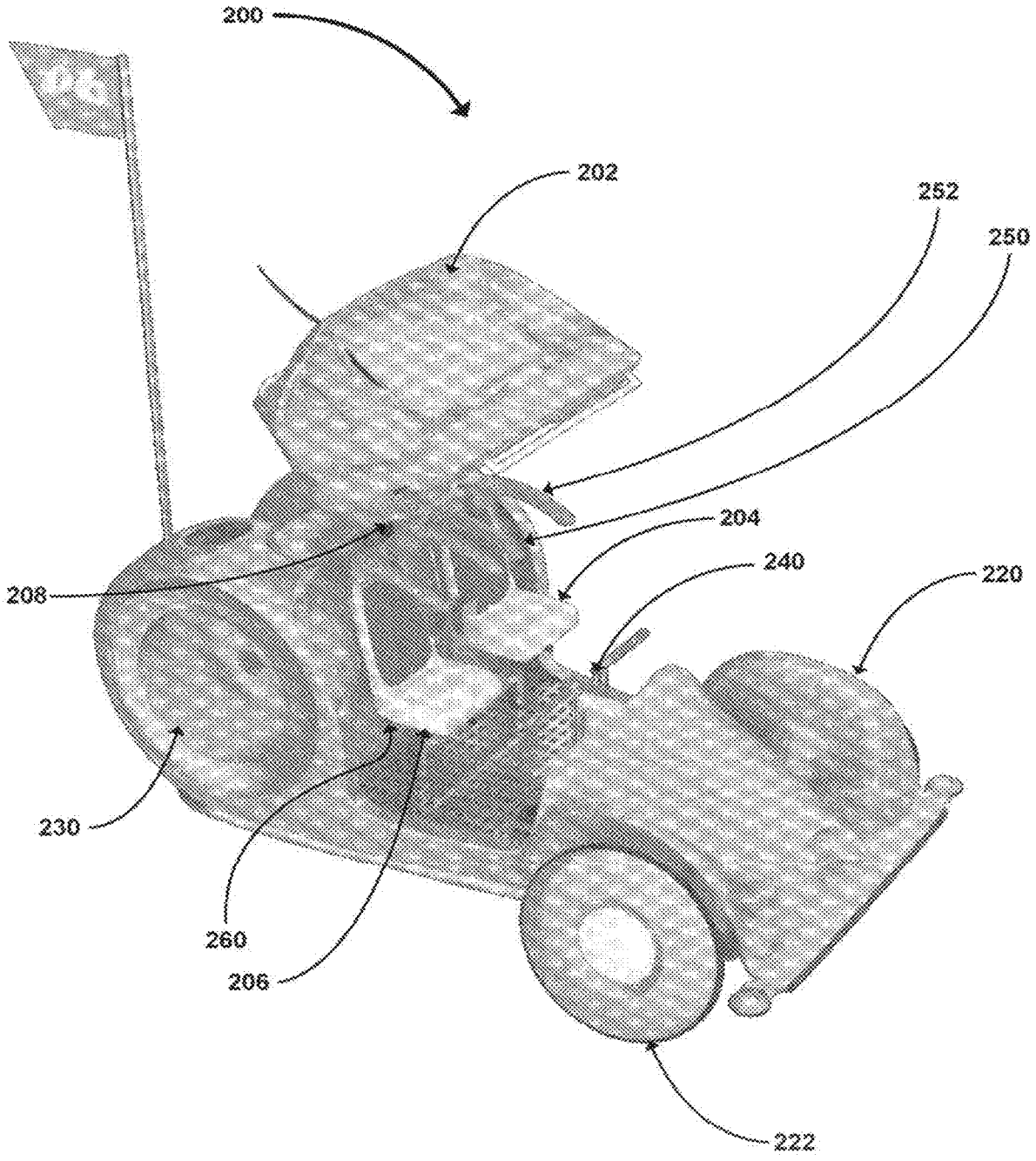
FIG. 3 is a view of one embodiment of an underwater vehicle which may be used in the underwater park ride system illustrated in FIG. 1 where a canopy of the underwater vehicle is shown in an open position.

FIGS. 2 and 3 illustrate embodiments of the underwater vehicle. FIG. 2 is a view of one embodiment of an underwater vehicle 200 which may be used in the underwater park ride system illustrated in FIG. 1. The underwater vehicle 200 is shown with a canopy 202 in a closed position (i.e., horizontal position). FIG. 3 is a view of one embodiment of the underwater vehicle 200 shown with the canopy 202 in an open position (i.e., vertical position). In some embodiments, the canopy is dimensionally designed to accommodate at least one guest and up to two guests. However, those skilled in the art will appreciate that the vehicle may be designed so that the canopy and vehicle can accommodate more than two guests. When the canopy 202 is in an open position (i.e., vertical position) the guests may enter and be seated on one of the seats (e.g, seats 204, 206). In some embodiments, a pair of seats are positioned side-by-side and are facing the front of the underwater vehicle. In other embodiments, additional seating capacity for more than two guests may be provided. The seats 204 and 206 are adjustable in a manner such that the shoulder height of each guest when seated is approximately at the same level. A vertical seat adjustment 260 for each seat allows the seat for each guest to be adjusted so that guests of varying torso lengths may be positioned beneath the canopy at relatively the same shoulder level. By having each guest at relatively the same shoulder level within the canopy, the water level for each of the guests may be maintained at a level below the top of the guests' shoulders. In some embodiments, a park attendant may make the necessary adjustments using the vertical seat adjustment 260. The vertical seat adjustment 260 may correspond to a measurement indicator utilized prior to the guests boarding the vehicle. The canopy 202 may be designed as an inverted or concave structure that is affixed to a pivot apparatus 208 that is affixed to the vehicle behind the seats. Prior to the underwater vehicle reaching a transition point where the descending ramp leads to the underwater world, the canopy 202 may pivot about the pivot apparatus 208 to position the canopy over the guest's head and shoulders. Thus, the pivot apparatus 208 allows the canopy 202 to pivot between a horizontal position (e.g., closed) and a vertical position (e.g., open). When the canopy is in the horizontal position, the canopy may be locked at an angle designed to capture or hold the greatest amount of air volume when the vehicle is underwater. Whereas when the canopy is in the vertical position, the canopy may be designed to provide the greatest ease for guests to load and unload from the vehicle. In addition, the canopy in the closed position creates a visually clear canopy of breathing air space that is designed to maintain the water level well below the guest's shoulders. In some embodiments, the canopy may by made substantially of clear acrylic.

As shown in FIG. 3, the canopy 202 includes a restraint system 250. In some embodiments, the restraint system 250 may include one or more shoulder pads (e.g., shoulder pad 252) formed in the approximate shape of guest's shoulders. The shoulder pads may be designed with a light spring tension and sufficient vertical movement to avoid placing excessive pressure on the guest's shoulders when the canopy 202 is closed. The restraint system 250 is positioned on the bottom of the canopy so that when the canopy structure closes, the combination of the restraint system and the vertical seat adjustment working in concert provides sufficient contact with the guest's shoulders to prevent unwanted vertical movement of the guests while they are seated within the vehicle.

Figure 4:
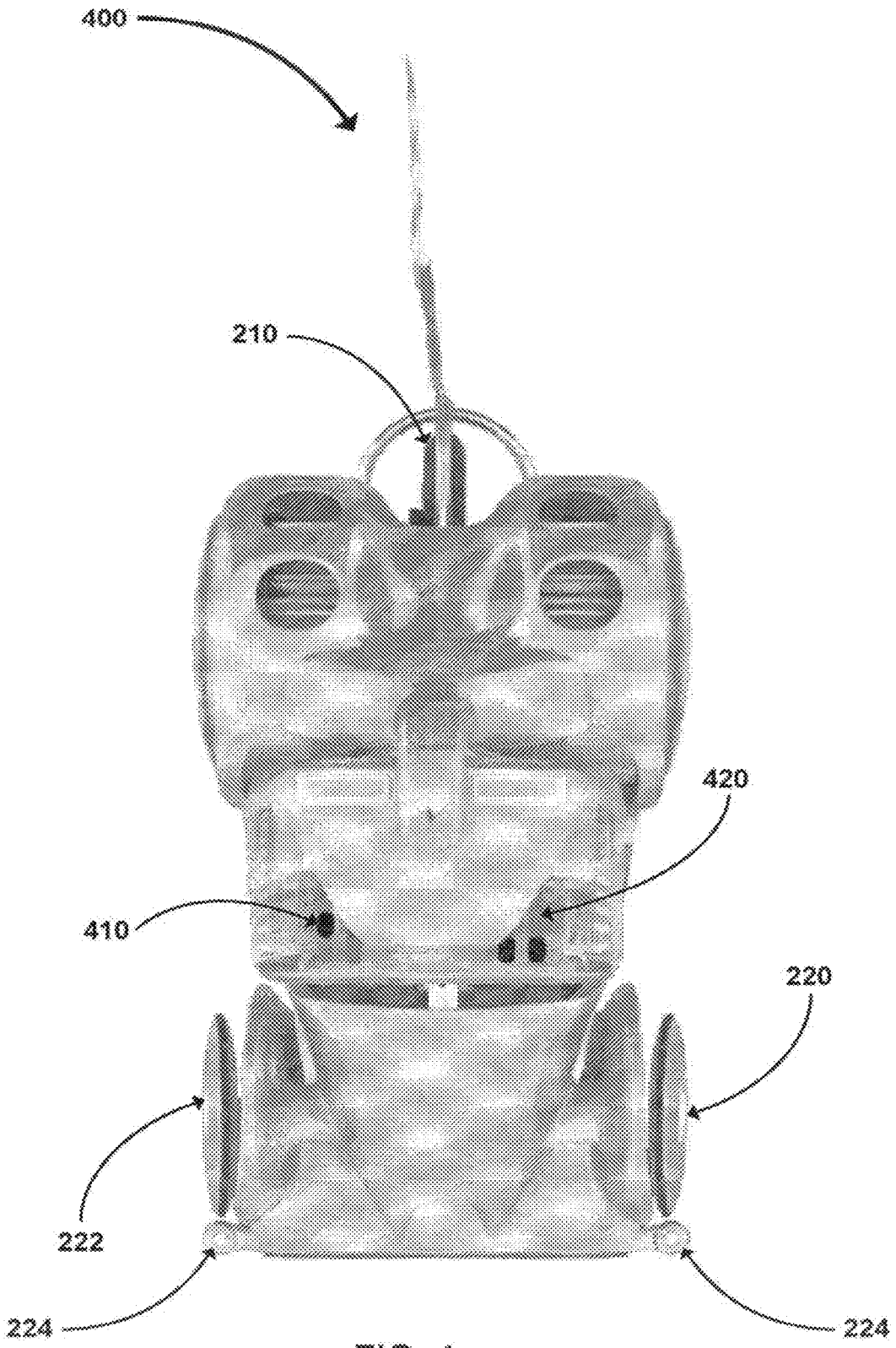
FIG. 4 is a top view of another embodiment of an underwater vehicle which may be used in the underwater park ride system illustrated in FIG. 1.

As illustrated in FIGS. 2, 3 and 4, the underwater vehicle 200 includes a rear drive wheel 210 (shown in FIG. 4) and two front steering wheels, one on each side of the vehicle (e.g., left front wheel 220 and right front wheel 222). The underwater vehicle further includes an air engine 230 that captures the supply of air bubbles emitted from the air dispensers located along the course. The underwater vehicle 200 also includes a steering mechanism 240. In some embodiments the steering mechanism may be configured as a center arm-rest mounted steering lever that allows either driver access to the steering mechanism. The steering mechanism may be configured so that the guests can maneuver the underwater vehicle to drive over as many bubbles as possible in a game like manner. As the underwater vehicle drives over the air dispensers which release the bubbles, the bubbles are channeled to fuel the air engine 230. As will be described in more detail in conjunction with FIGS. 6 and 7, the lift of rising air that is captured by the air engine 230 causes the rotor wheels to rotate and propels the underwater vehicle forward along the course. The single rear wheel provides superior turning radius versus a vehicle with more than three wheels and also improves the drag coefficient over a vehicle with more than three wheels. The left and right from wheels 220, 222 are designed to rotate in the forward direction and may lock into place whenever the wheels attempt to rotate in the reverse direction. This design allows the vehicle 200 to ascend out of the pool via the mechanical transporting apparatus operating on the ascending ramp while preventing the vehicle from rolling backwards or descending backwards into the direction of the pool during the ascent from the pool onto the carousel, whenever the vehicle may be resting on its wheels during ascent. Other methods of ascent may include the vehicle engaging a pair of ascending conveyor belts, which are moving in parallel, with a gap wide enough between the ascending belts to allow the rear wheel 210 to fit between the ascending belts and narrow enough for the left front wheel 220 and right front wheel 222 to over hang the outside of the ascending belts, to remove all contact of the wheels with the driving surface. This design allows the vehicle 200 to ascend out of the body of water with the vehicle resting entirely on its underside or chassis while in contact with the ascending conveyor belts, thus allowing the powered rear wheel to spin freely and all steering input to the forward wheels are without consequence to vehicle positioning or movement during ascent. The gap between the ascending conveyor belt allows for air dispensers, located along pathway of the ascending conveyor belts, to release air bubbles beneath the vehicle and into the passenger canopy 202 to supply refreshed air to the passengers.

FIG. 4 is a top view of another embodiment of an underwater vehicle 400 which may be used in the underwater park ride system illustrated in FIG. 1. As shown, both the left and right front wheels 220, 222 are designed with a negative camber angle wherein the angle between the vertical axis of the wheels and vertical axis of the vehicle when viewed from the front or rear of the vehicle illustrates that the bottom of the wheels are farther out than the top of the wheels. The bottom of the wheels are at the widest point of the vehicle's dimension. The negative camber angle of the wheels 220, 222 allow an improved turning radius versus wheels without negative camber. Horizontal guide wheels 224 located forward and slightly wider than the outside width of the forward wheels 220, 222 are designed to make contact with the curb or sidewall surface of the track 804, 802 prior to the forward wheels making contact. The horizontal guide wheels 224 are designed to roll against the vertically oriented curb or sidewall to minimize the amount of friction or resistance the vehicle may experience if the rider is determined to counter-steer the vehicle throughout the course thus attempting to slow the vehicle. Regardless of steering inputs by the guests to maneuver the vehicle left or right, the design of the horizontal guide wheels 224 in cooperation with the design of the tracks prevent the vehicle from going off course.

The underwater vehicle 400 further includes adjustable foot beds (e.g., foot bed 410). In some embodiments, the adjustable foot beds include vamps that are designed to allow the guests to slip their feet into the foot beds to secure their feet in place and to comfortably counter the body's positive buoyancy or tendency to float. The foot beds in combination with the restraint system prevent the guest from becoming free of the vehicle. The adjustable foot beds are mounted to a rail 420 oriented along the length axis of the vehicle, which allows for adjusting the position of the foot beds along the rail to accommodate the various heights and lengths of the guests. The combination of the shoulder pads located on the underside of the canopy and the foot beds with vamps provide stability to the guests within the vehicles as they undergo the underwater driving experience. This stability may then be achieved without requiring mechanical mechanisms to restrain the guests. Therefore, in case of an emergency, the guests only need to remove their feet from the foot beds to free themselves from the vehicle.

Figure 5:
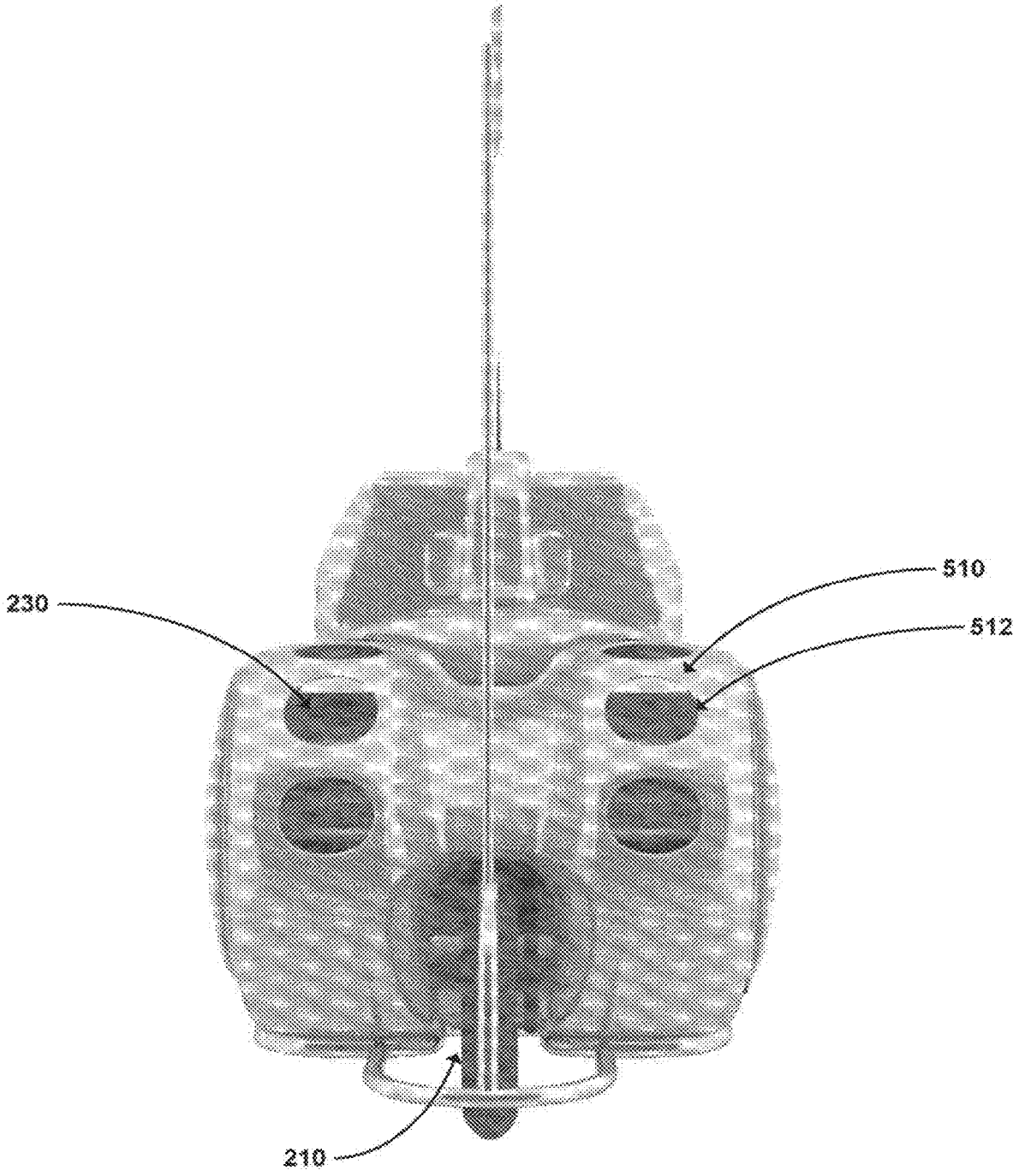
FIG. 5 is a back view of one embodiment of an underwater vehicle which may be used in the underwater park ride system illustrated in FIG. 1.

FIG. 5 is a back view of one embodiment of an underwater vehicle which may be used in the underwater park ride system illustrated in FIG. 1. The air engine 230 is enclosed within a rear enclosure 510 that has one or more openings (e.g., opening 512) that allow air bubbles to freely flow out of the rear enclosure 510. In some embodiments, the air engine includes two air engine wheels, one on each side of the rear wheel 210.

Figure 6:
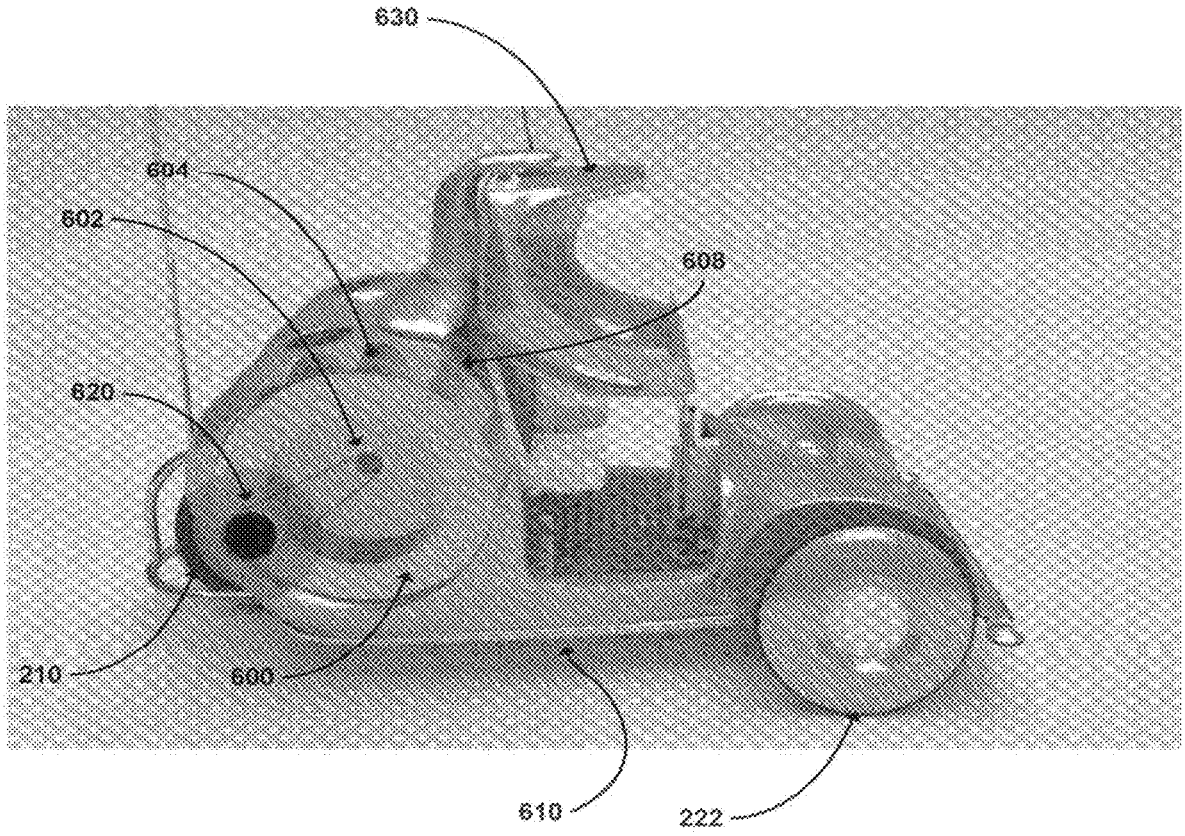
FIG. 6 is a conceptual side view of one embodiment of an underwater vehicle which may be used in the underwater park ride system illustrated in FIG. 1.

FIG. 6 is a conceptual side view of one embodiment of an underwater vehicle which may be used in the underwater park ride system illustrated in FIG. 1. FIG. 6 illustrates the right side of the underwater vehicle and thus only the right side of the air engine 600 and the right front wheel 222. The air engine includes one or more air wheels or rotors (e.g., air wheel 600) with a plurality of containers 702 (FIG. 7) connected via a hub and axle 602 to each rotor 600. The plurality of containers each have an open side and shaped closed side and being designed to collect the force of rising air bubbles channeled from beneath the vehicle via a plenum 610 under the vehicle. The air bubbles force the containers 604, 702 towards the surface of the water which causes the rotor 600 to rotate as the open end captures the bubbles and is forced upward and then releases the bubbles (i.e., air) when the containers 702 have rotated to a position in which the rounded closed side is down and the open side is up (e.g., container 604). The rotation of the air wheel 600 naturally allows the air supply to escape containment. Thus, the air engine generates mechanical power by harnessing the force of rising air bubbles delivered beneath the vehicle. The plenum 610 further provides ducting to divide a small portion of the overall air suppled beneath the vehicle into a canopy 630. The mechanical power that is generated propels the vehicle along the course. The rotating rotor is connected to the wheel via drive belts or non-ferrous chain 620. In some embodiments, the rotating rotor 602 is connected to the drive wheel through a drive reduction. The total amount of power being generated to the drive wheel may be in excess of 100 foot-pounds of torque. With a measured flow of air dispersed along the track to the air engine, a controlled pace of approximately 2 mph may be maintained. The air engine thus transforms rising bubble energy into forward motion of the vehicle. In some embodiments, as the underwater vehicle passes over the top of strategically placed air dispensers, a mechanical lever makes contact with the flat, permeated, bottomed surface of the vehicle causing actuation of a normally closed actuator valve to remain in an open position until the vehicle releases contact with the mechanical lever. During contact with the mechanical lever, the air dispensers discharge bubbles along the length of the vehicle through the permeated flat-bottomed surface of the vehicle and into the plenum 610 that is shaped to channel and deliver the flow of rising gas directly beneath a series of inverted containers 604 and a lessor proportion of gas into the canopy 608. The gas collected by the plenum 610 on the underside of the vehicle are directed through ducting to the air engine and a smaller proportion of gas into the canopy. In addition, as will be described in conjunction with FIG. 11, a portion of the discharged bubbles are directed into the canopy to supply air for the guests to breathe.

Figure 7:
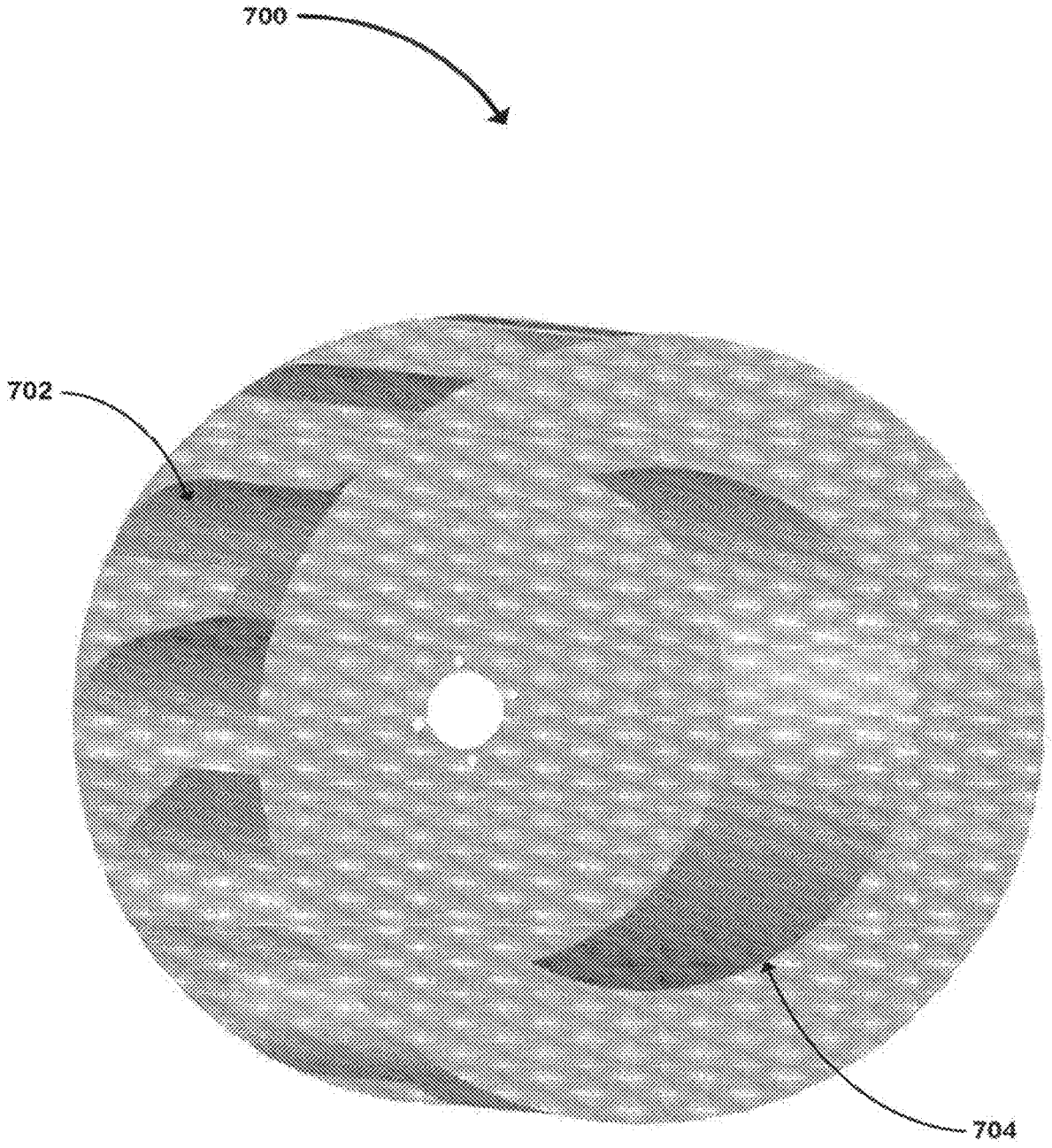
FIG. 7 is a view of another embodiment of an air engine which may be used in the underwater vehicles illustrated in FIGS. 2-6.

FIG. 7 is a view of another embodiment of an air engine 700 which may be used in the underwater vehicle illustrated in FIGS. 2-6. In this embodiment, the air engine 700 includes containers 702 that are shaped as curved fins along the rotational axis, along with vertical side walls to contain the gas during the uplift forces being generated. The curved fins are affixed to the rotor 704 and are forced upwards by the bubbles which causes the rotor to rotate and drive the belt, or chain, as described above. The curved fins 702 are designed to minimize the drag associated with the downward rotational travel of the rotor when not producing power for propulsion. To aid in the understanding of the operation of the air engine, one can imagine a waterwheel using the power of a flowing stream to scoop buckets of water, but in the present application, a pair of rotating wheels each having multiple scoops (or curved fins) affixed to the outside of a rotor capture the supply of air bubbles. The lift of rising air captured within the scoops causes the rotors to rotate. The rotating rotors are connected to a drive wheel through a drive reduction. Those skilled in the art will appreciate that many variations of the air engine may be envisioned to harness the power of the air bubbles and to deliver air supply to the guests in the vehicle without departing from the claimed invention.

FIG. 8 is a view of one embodiment of interlocking underwater tracks which may be used in the underwater park ride system illustrated in FIG. 1. The layout for the underwater course is determined by the size, shape, and placement of various underwater tracks (e.g., tracks 802, 804). As shown, track 802 is essentially a straight track that could be of various lengths and track 804 is a curved track that could be of various lengths and radii. In addition, tracks may include sections with rises, depressions, or surface irregularities to simulate vehicle movements in the vertical and horizontal axis. Those skilled in the art will appreciate that tracks may be of various lengths, curve radii, surface irregularity, and the like without departing from the claimed invention. The underwater tracks 802, 804 include an interlocking mechanism that allows two tracks of various sizes and shapes to interlock with each other. For example, in some embodiments, the interlocking mechanism may include one or more holes 810-816 at one end of the track and pins 822, 824 at the other end of the track. The holes of one track then mate with the pins of the adjoining track.

Each of the tracks are designed with a vertically rising curb 830 tall enough to engage the horizontal guide wheels 224 to keep the underwater vehicles within the pathway of the course. The tracks may be designed to be wider than the width of the underwater vehicles so that the guests can maneuver the vehicle within the confines of the track to simulate a driving like experience. The course may use tracks to make sweeping turns, straight paths, and the like as the course traverses a variety of stimulating visual effects such as arches, bubble curtains, and themed features. In some embodiments, the tracks may be two feet wider than the underwater vehicle. However, those skilled in the art will appreciate that the width of the tracks may vary without departing from the claimed invention. The course may be designed so that the underwater vehicles traverse the course in various time periods, such as providing four minutes of driving per vehicle. The driving time period may be controlled by the length of track and the amount of air bubbles available to the air engine.

The amount of air bubbles available to the air engine is dependent on the number of air dispenser outlets embedded in the track and the amount of air volume dispensed by each air dispenser. For example, if it is desirable to slow the underwater vehicle down, the corresponding track may have fewer air dispenser outlets or dispense a lower volume of gas so that the air engine propels the vehicle at a slower pace. In some embodiments, the air dispenser outlets 84) may be distributed along a central axis of the track. However, in other embodiments, the air dispenser outlets may be more random. Compressed air is output via each of the air dispenser outlets. In some embodiments, air supply lines may be integrated internally within pre-fabricated track segments. In other embodiments, air supply lines may be external to the track segments and mated with the air dispenser outlets with mating couplings. In other embodiments, air supply lines may be placed within the center recess of the tracks and accessible via removable, permeated, covers. The tracks include fastening points (not shown) for securing the track to foundation mounts installed within the pool prior to track installation. Embedded diffusers emit a quantity of properly sized air bubbles through a corresponding air dispenser outlet. The air bubbles may be delivered from a compressed air delivery system. The embedded diffusers may receive controlled amounts of air volume, controlled by variable valves which allow the operator to increase, decrease or vary the amount of air volume emitted from each of the embedded diffusers. In the case of high volume passenger use or the need to increase passenger capacity per hour, the amount of air volume emitted from the embedded diffusers may be increased to accelerate the vehicles, thus increasing traveling speed for shorter ride duration. Independent control over specific embedded diffusers or control of a zone of embedded diffusers allows for increased or decreased air volume introduced into the air engine to achieve greater torque when climbing or driving over varying elevations or terrain features or to adjust vehicle speeds. Increased air supply, or torque as the vehicles approach a powered uptake or rubber belt ascending conveyor apparatus, assures vehicle placement on the conveyor belt. A reduction in the amount of air supplied to the air engine will cause the vehicle to slow while passing unique themed features along the course, or provide for photo opportunities. These are some of the capabilities benefiting from variable air volume control of the embedded diffusers.

Figure 9:
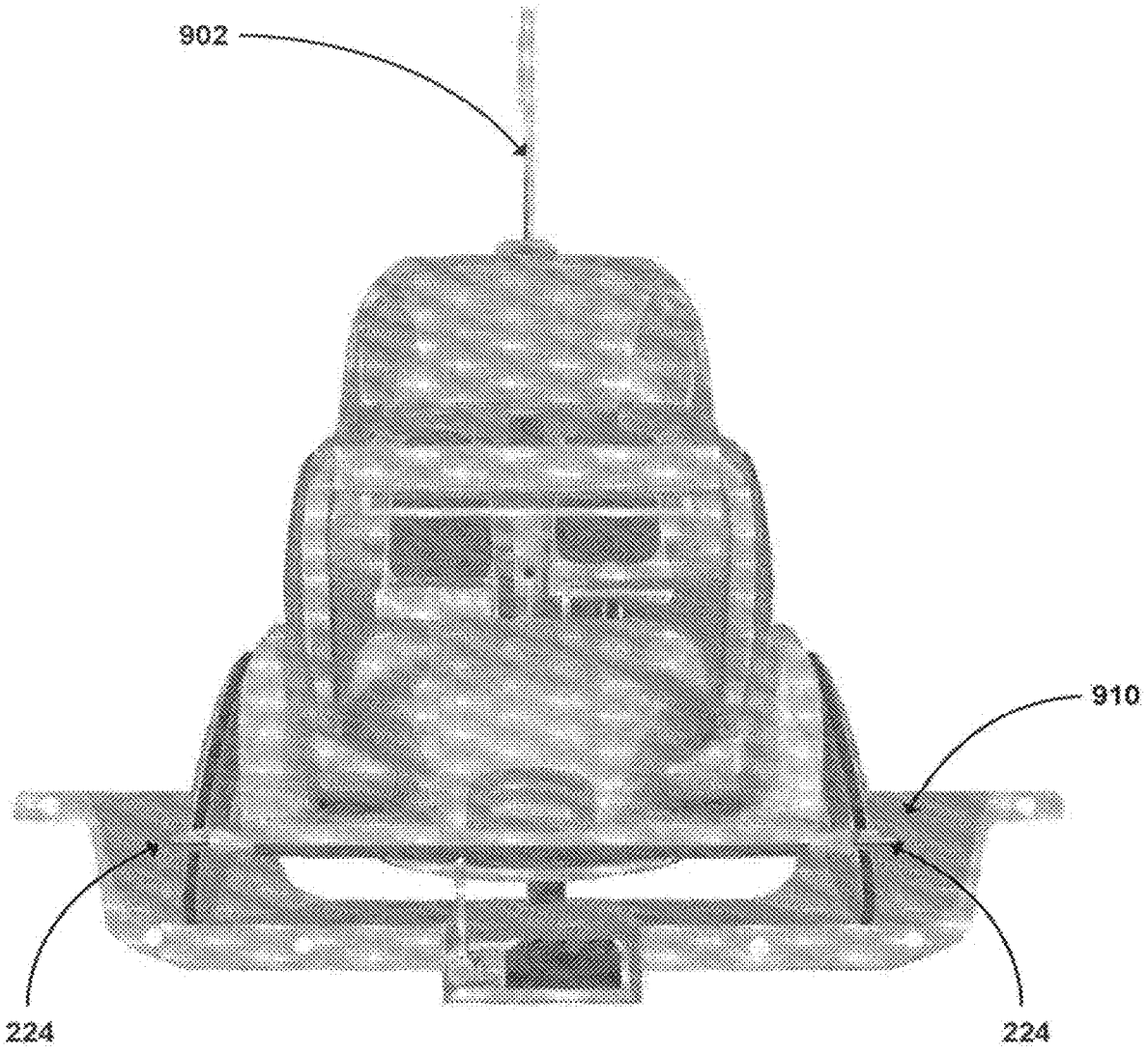
FIG. 9 is a conceptual view of one embodiment of an underwater vehicle illustrated in FIGS. 2-6 on the interlocking underwater tracks illustrated in FIG. 8.

FIG. 9 is a conceptual view of one embodiment of an underwater vehicle illustrated in FIGS. 2-6 on the interlocking underwater tracks illustrated in FIG. 8. A space 910 is shown on the side of the vehicle between the edge of the track and the vehicle. As discussed above, the design of the track and the horizontal guide wheels 224 of the vehicle prevents the vehicle from going off course, but by having the track wider than the vehicle, the guests may steer the vehicle along the track while allowing some lateral movement along the track to better simulate a real driving experience. The underwater vehicle may include a vertical pole 902 that rises out of the water with a flag affixed to its end, or to provide a radio transmitter antennae for communication between vehicles and safety staff. The flag can be viewed above the water surface to easily identify each underwater vehicle in the pool.

Figure 10:
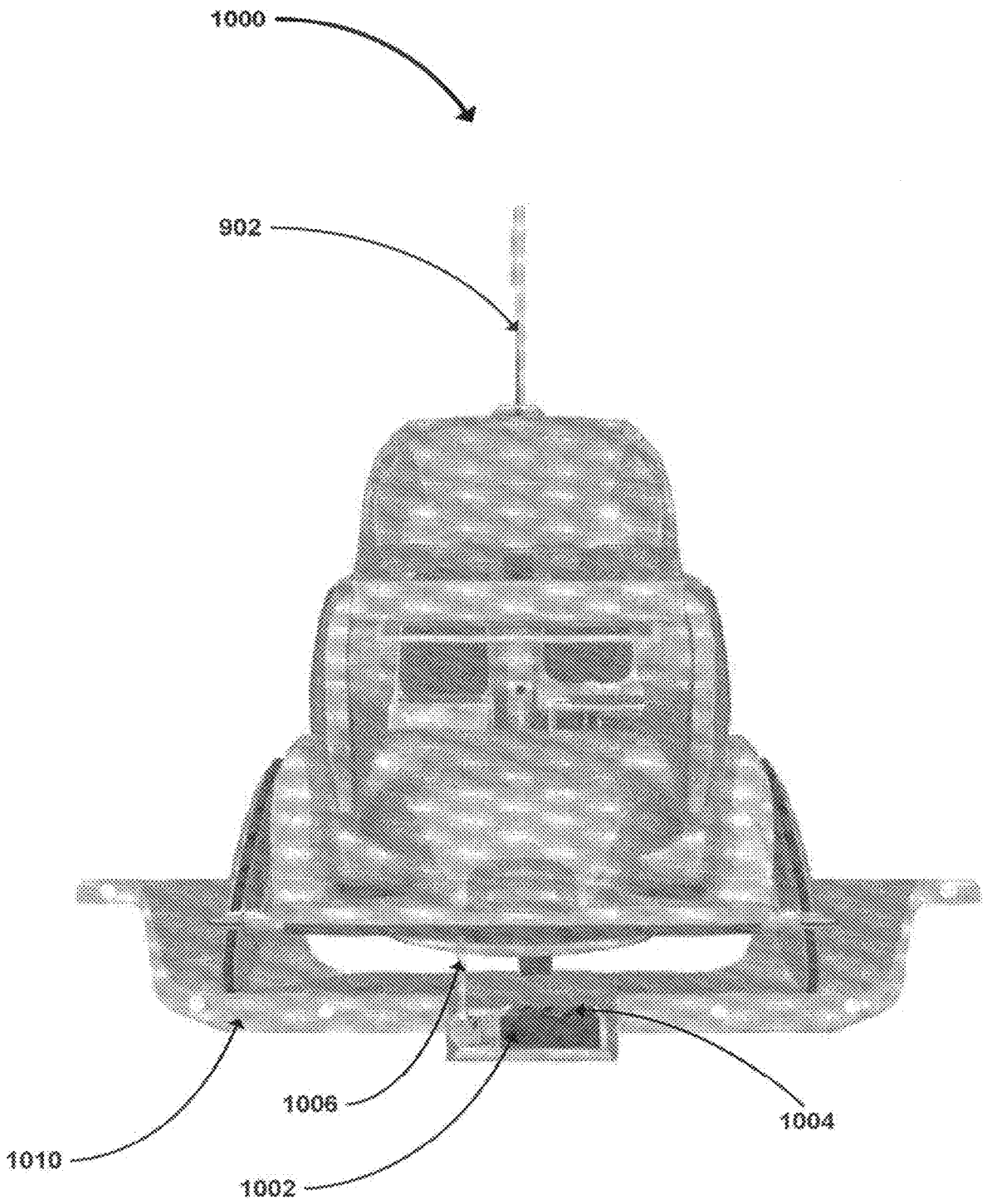
FIG. 10 is a view of one embodiment of an underwater vehicle illustrated in FIGS. 2-6 on the interlocking underwater tracks illustrated in FIG. 8.

FIG. 10 is a view of one embodiment of an underwater vehicle illustrated in FIGS. 2-6 on the interlocking underwater tracks illustrated in FIG. 9. The underwater vehicle 1000 is shown traveling on a track 1010. The track includes the embedded diffusers 1002 and mechanical wand 1006 projecting upwards from the air dispenser outlets 1004. The ground clearance of the vehicles are lower than the height of the mechanical wand with linkage to the embedded diffusers and are designed to be unavoidable as each vehicle passes over air dispensers located over the entirety of the track. These embedded diffusers may be located at various intervals along the track. The underwater vehicle includes an inverted funnel shaped apparatus, or plenum, mounted between the flat, permeated, bottom of the vehicle and the level of the interior floorboard. This in combination with vertically arranged ducting or flue leading up from the base of the vehicle to the air engine allows bubbles to enter the air engine to drive the rotor and a proportionally smaller duct enables the supply of air to enter the canopy.

Figure 11:
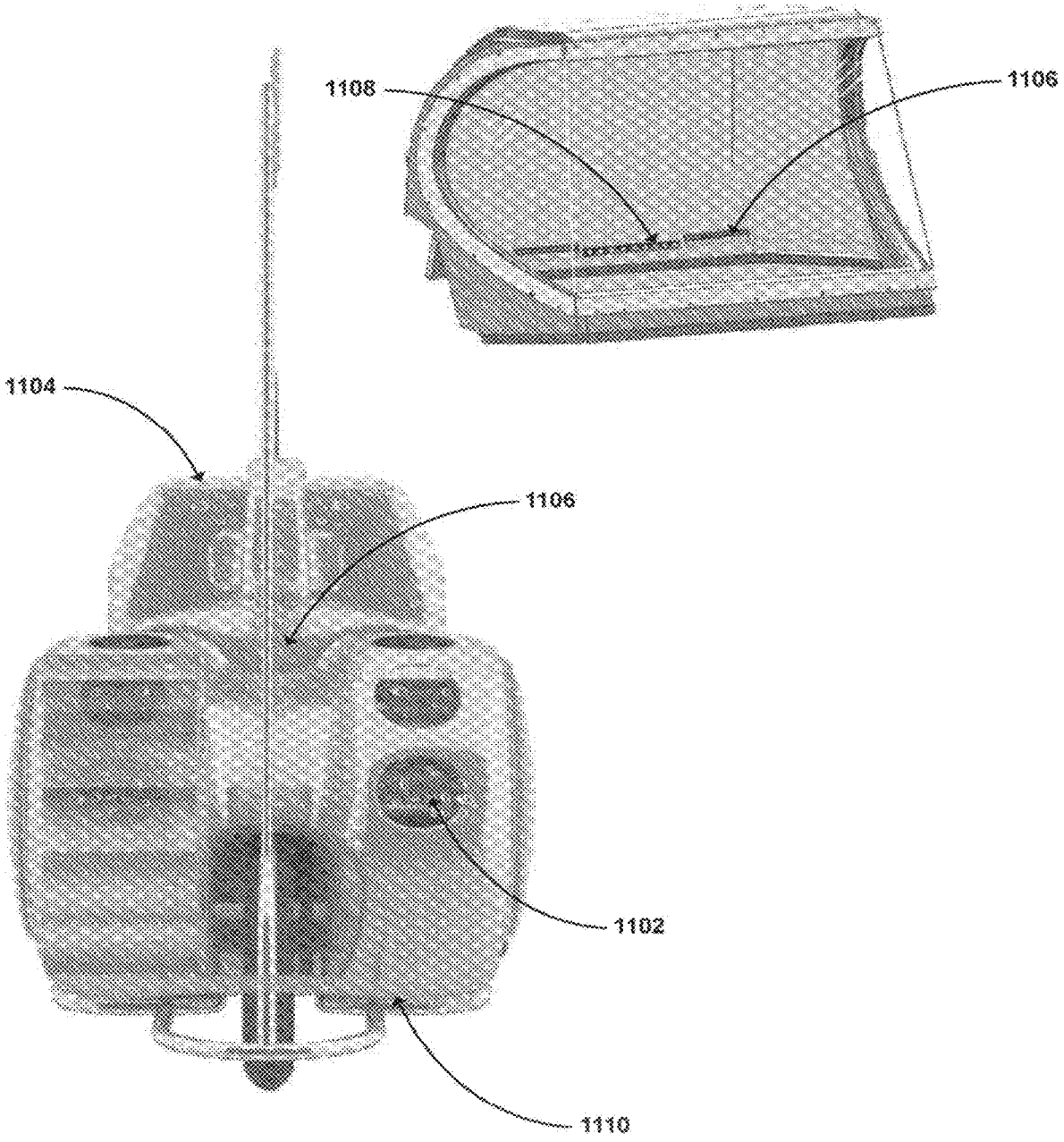
FIG. 11 is a conceptual view of the air engine and canopy of the underwater vehicle illustrated in FIGS. 2-6.

FIG. 11 is a view of the air engine 1102 and the canopy 1104. The gas collected by a plenum on the underside of the vehicle directs a significant proportion of the gas through ducting to the air engine and a smaller proportion of the air supply 1106 is supplied directly into the canopy, thereby supplying air for propulsion and for the guests to breathe. As discussed above, the course has numerous points along the track where vertically discharged and defused compressed air gas is released beneath the vehicles as they pass over the air dispensers. As the vehicles pass over the release of compressed air gas, a downward facing plenum 1110 located on the underside of the vehicle captures the vertically rising air bubbles. The air supply is then directed via convex channels designed into the underside of the vehicle chassis and is released directly into the air engine intake and passenger canopy. A diffuser located at the top of the plenum inside the passenger canopy 1106 is and positioned above the water level within the canopy to eliminate splashing of water on the guests when bubbles are released into the canopy. As compressed air enters the canopy and begins to displace the air volume within the canopy, excess air is forced through exhaust ports 1108 located at the water level high-mark at the rear of the canopy. The vertical location of the exhaust ports 1108 determines the high water mark within the canopy at approximately just below the passengers' shoulders. The canopy may be a concave shaped air space wherein participants are breathing air within the canopy while naturally exhaling air with higher levels of carbon dioxide molecules. The carbon dioxide molecules, being heavier, will sink or reside at the lower level of the air space within the canopy. As the vehicle collects and transmits a supply of compressed air into the interior of the passenger canopy structure, the air with higher levels of carbon dioxide within the canopy are first displaced and forced out of the canopy via exhaust ports located at the rear and established water line within the canopy structure determined by the exhaust ports 1108. The supply of fresh air will continuously supply the needs of the passengers throughout the duration of the course. The canopy provides a dry compartment of air above the participants' shoulders via an entrapment of air within an inverted body or concave chamber which remains open at the bottom. The effect being similar to submersing a glass upside-down into water where the air remains captured within the containment of the glass. The inverted canopy structure, combined with a relatively consistent depth and minimal pitch or roll movement of the passenger vehicle causes the water level to remain relatively constant within the volume of the interior canopy space.

Figure 12:
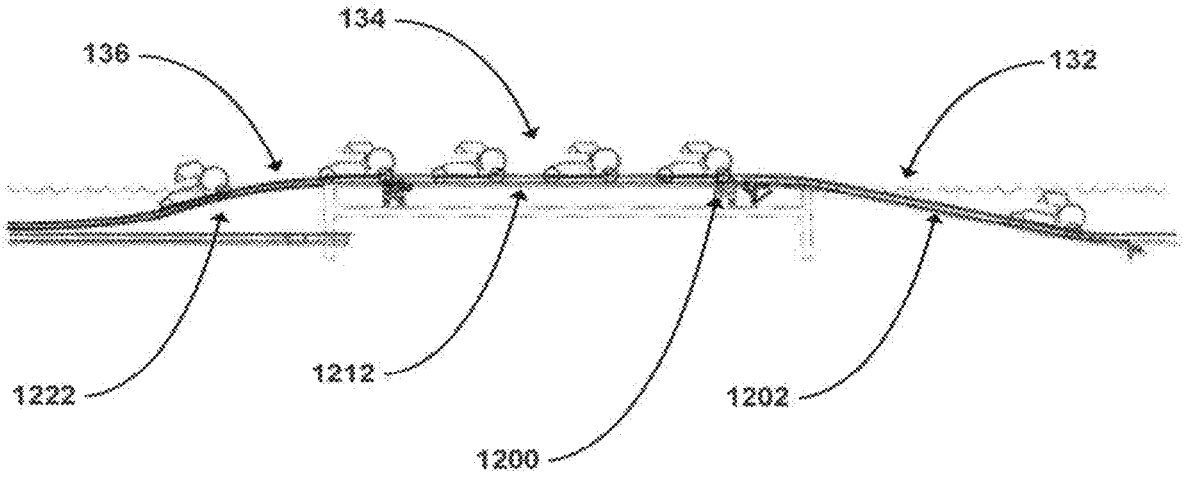
FIG. 12 is a diagram of one embodiment of the carousel illustrated in FIG. 1.

FIG. 12 is a diagram of one embodiment of the carousel used for the underwater park ride system illustrated in FIG. 1. The carousel shown in FIG. 12 includes the ascending conveyor 132, the moving sidewalk 134, and the descending ramp 136. The underwater vehicles ascend and descend from the water via the carousel or conveyor belt system. In some embodiments, the moving sidewalk may be configured to travel at a slower speed to provide a set time period (e.g, 90 seconds) to unload and load guests for each vehicle and to calibrate the reintroduction of vehicle back onto the descending ramp at consistent intervals or vehicle spacing as determined by the operator. A mechanical transporting apparatus 1200 drives the carousel and may be designed to move the vehicles at a controllable pace around the carousel. The mechanical transporting apparatus begins the moment the underwater vehicle transitions onto the ascending conveyor 132 and ends upon re-entry into the water after the descending ramp 136. As the underwater vehicle ascends from the water on the ascending conveyor 132 and onto the moving sidewalk 134, guests unload from the vehicle and other guests load into the underwater vehicle from the guest platform. Once the new guests have loaded into their underwater vehicle, the carousel delivers the underwater vehicle onto the descending ramp 136 where gravity begins to take over and transports the underwater vehicle into the depths of the pool and onto the underwater course so the guests can enjoy their underwater driving experience. In some embodiments, the mechanical transporting apparatus 1200 may include three separate conveyor belts 1202, 1212, and 1222. The conveyor belts may be arranged in a straight line as shown, or may include curves and corners depending on the dimension of the pool and the layout of the course. As the vehicle nears the end of the course, one last blast of air bubbles from the embedded diffusers drives the vehicle onto the ascending conveyor belt 1202. Because the front wheels of the vehicle are designed to only rotate in the forward direction, the wheels lock as soon as the vehicle begins to incline upwards and to move with the conveyor transporting the vehicle up and out of the water and onto the unloading/loading carousel. In some embodiments, the vehicle will ascend up and out of the water utilizing the bottom of the vehicle chassis to rest on top of a split set of conveyor belts 1202 designed to allow the rear drive wheel and forward steering wheels to remain suspended above any surface contact while the friction between the vehicle and conveyor belts easily hold the vehicle during the ascent.

In one configuration, vehicles on the ascending conveyor 132 may start at 100 FPM (feet per minute) and adjust to a slower speed of 40 FPM when the vehicle reaches the end of the ascending ramp. When the vehicles move onto the moving sidewalk 134, the vehicles may be spaced at twelve feet centers or intervals determined by the operator. Once the vehicle is fully on the moving sidewalk, guests can begin unloading the vehicle. A staff attendant may release the canopy lock, pivoting it upwards as the guests unload from the vehicle. A line of guests wait their turn to load into the vehicles. The vehicles continue at approximately 40 FPM while the guests unload and load, giving approximately 44 seconds when the moving sidewalk is approximately 37 feet and 11 inches. Moving sidewalk lengths and speed may vary. It is desirable to have the guests properly situated in the vehicles once the vehicle gets near the end of the moving sidewalk. From the moving sidewalk conveyor 1212, the vehicles transition to the descending conveyor or ramp 136, 1222. Once the vehicle is completely on the descending conveyor or ramp 136, 1222, the vehicle accelerates to enter onto the tracks at a specified interval.

Figure 13:
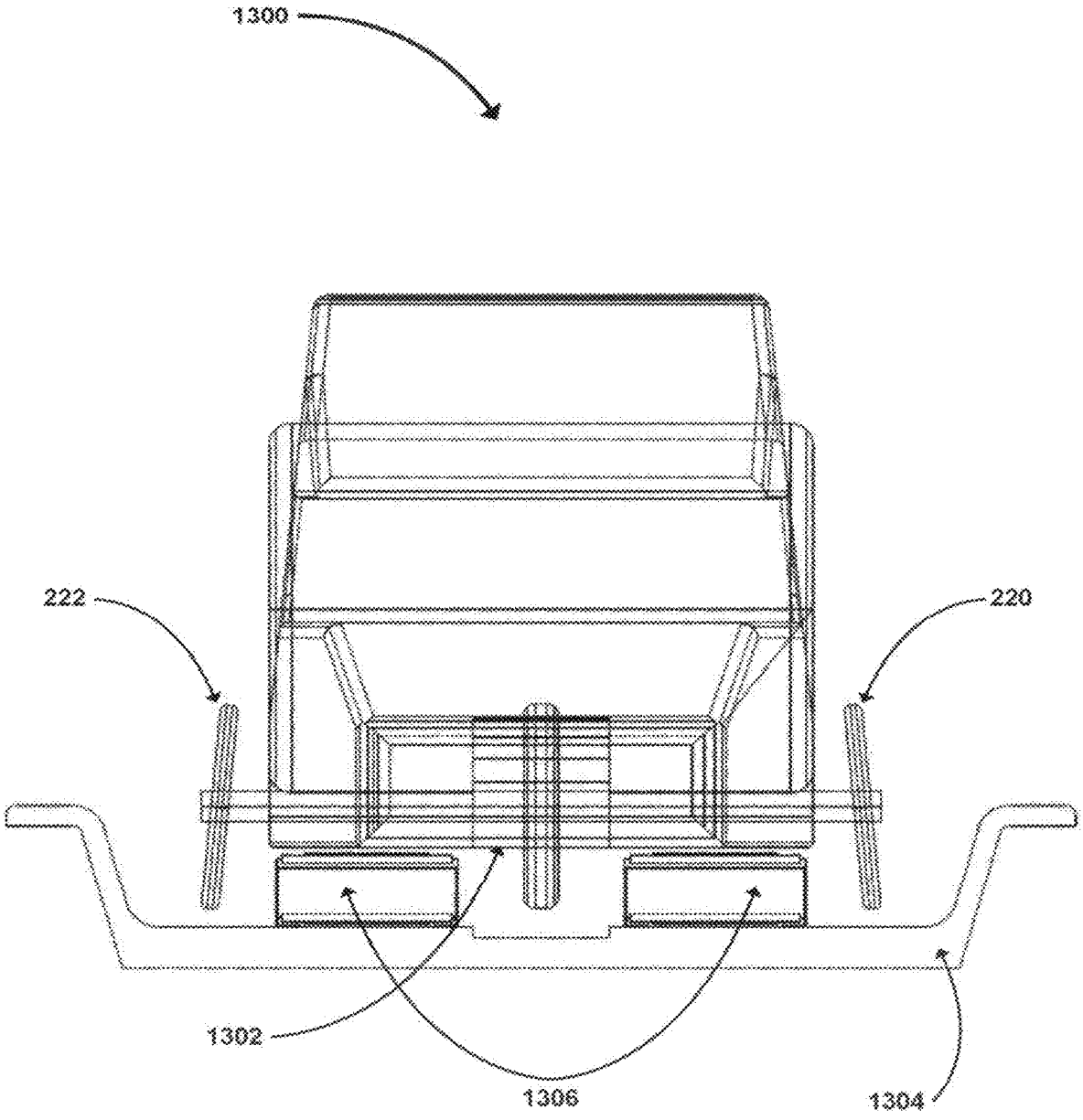
FIG. 13 is a view of one embodiment of the underwater vehicle on the carousel illustrated in FIG. 12.

FIG. 13 is a view of an underwater vehicle 1300 being transported on the ascending conveyor or carousel used for the underwater park ride system illustrated in FIG. 1. The underwater vehicle is designed with a flat bottom 1302 between the two front wheels 220, 222 that allows for conveyance on the carousel. The conveyor belts 1306 lifts the wheels off of the track 1304 while being transported on the carousel.

Figure 14:
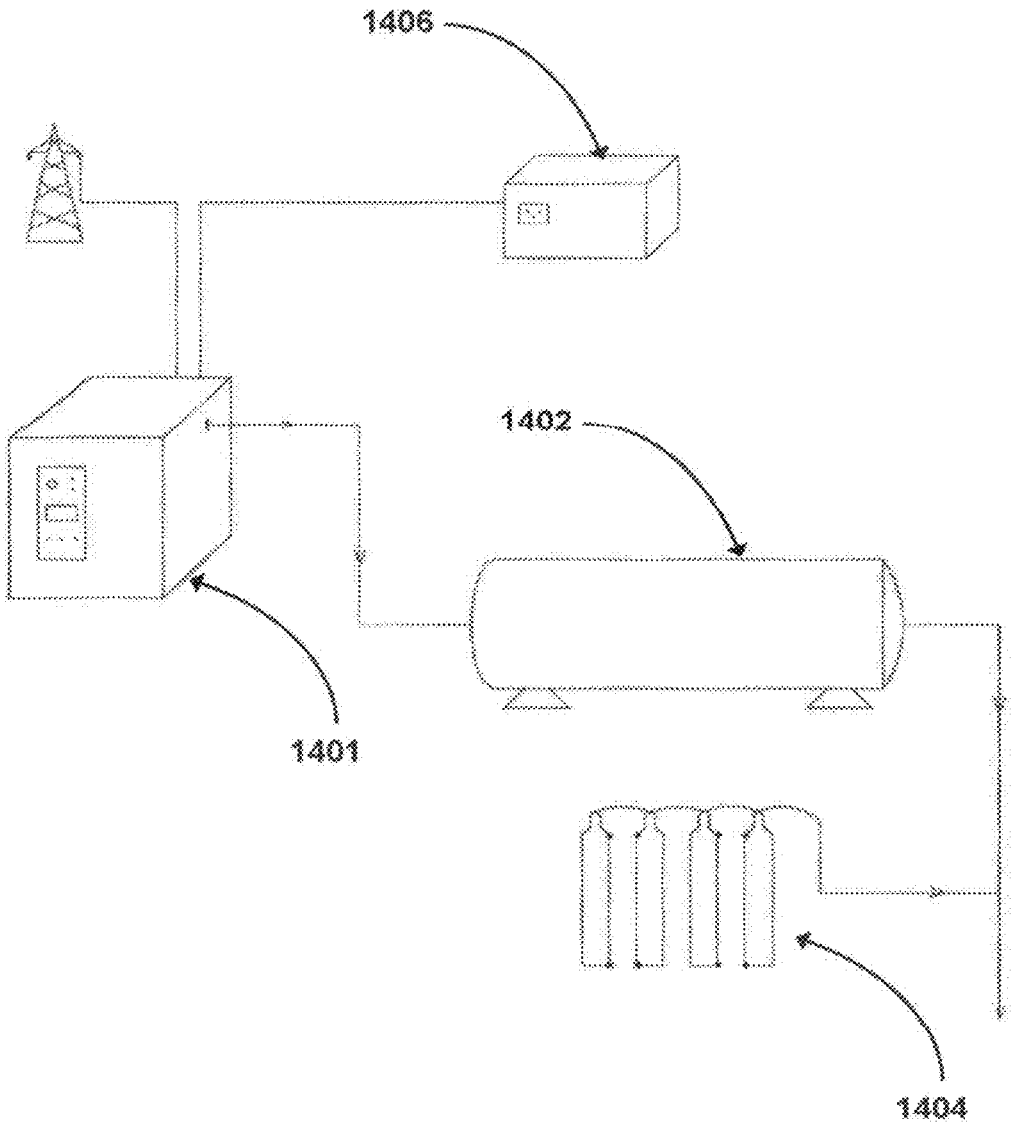
FIG. 14 is a view of one embodiment of a compressed air delivery system which may be used in the underwater park ride system illustrated in FIG. 1.

FIG. 14 is view of one embodiment of a compressed air delivery system which may be used in the underwater park ride system illustrated in FIG. 1. The electrical power supply to the compressor system, includes redundant components designed to provide continuous power and air flow to the vehicles and conveyor systems in case of main electrical supply failure. The underwater park ride system is powered by at least one scroll compressor system 1401. If power is lost to the compressor(s), the underwater park ride system is designed in a manner such that a large receiver tank 1402 will host a volume of air large enough to continue supplying air for the maximum capacity of vehicles on the course for a period of time long enough to complete the course distance. High pressure reserve cylinders 1404 provide redundant back-up air supply, should the receiver tank coupled to the scroll air compressors, be depleted. The underwater park ride system provides further safety by including a back up generator system 1406 to supply electrical redundancy to the compressors and the variable speed electric motors powering the conveyor systems.

Figure 15:
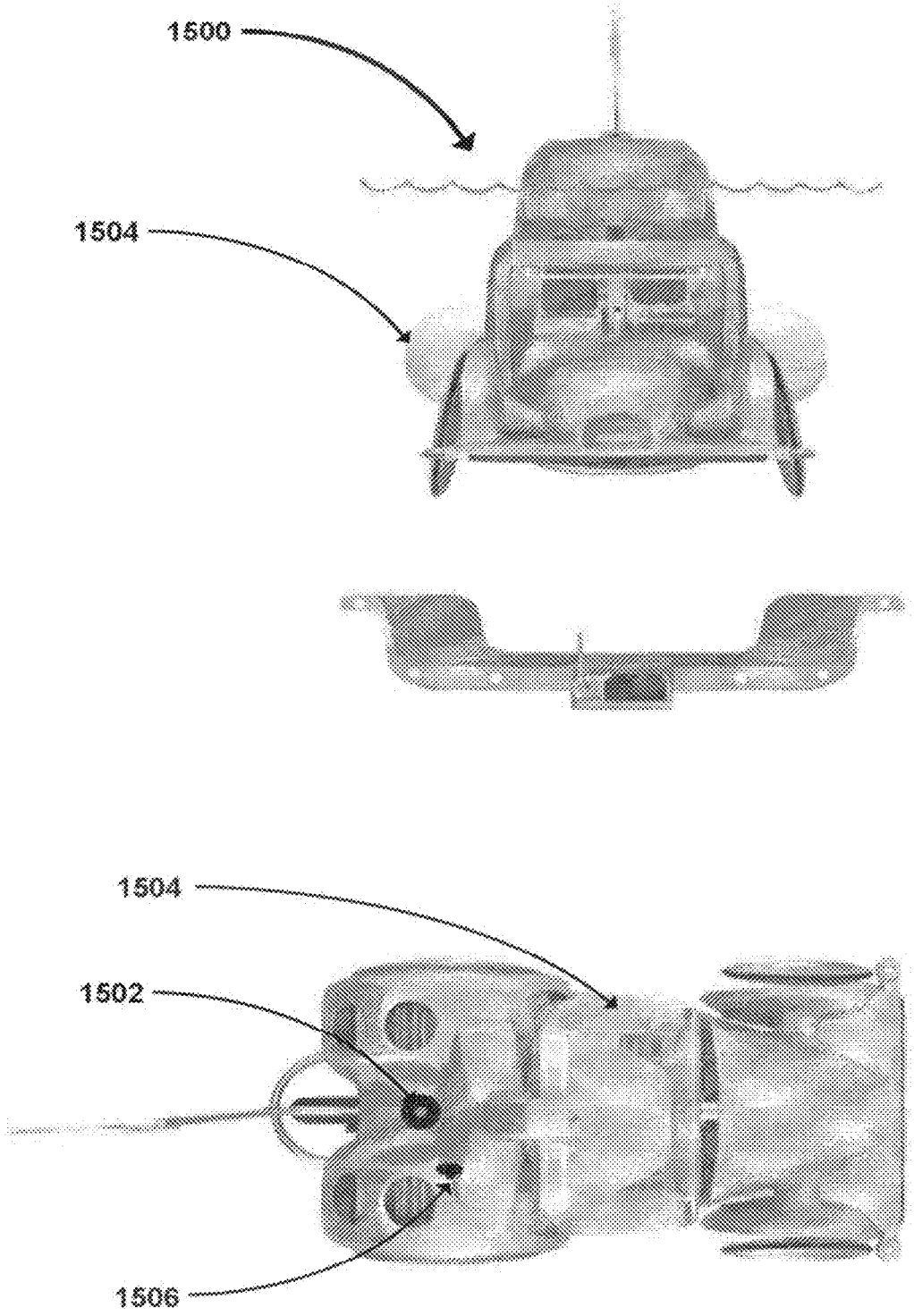
FIG. 15 is a view of one embodiment of the underwater vehicle including a self-contained emergency air supply system.

FIG. 15 is a view of one embodiment of the underwater vehicle 1500 indicating a self-contained emergency air supply system 1502 located on each of the vehicles designed to provide emergency air supply to the passenger canopy, and to lift the vehicle from the course and to the waters surface in case of an emergency requiring removal of a vehicle from the track, or an evacuation of guests. If main electrical power is lost and the generator power 1406 is incapacitated, and the air within the receiver tank 1402 has been depleted and the high pressure reserve cylinders 1404 have been depleted, each vehicle incorporates an small high-pressure air cylinder 1502 that can be engaged by safety staff to inflate one or more pneumatic bladders 1504 to bring the vehicle to the surface. One will note that the top of the vehicle canopy may be less than two feet beneath the surface under normal touring circumstances. By inflating the pneumatic bladder(s) 1504, the vehicle will rise to the surface to better allow guests to more safely exit the vehicle. If a vehicle becomes mechanically disabled and blocks the movement of vehicles coming from behind, a safety staff member can inflate one or more pneumatic bladders 1504 to raise the vehicle to the surface where it can be floated to a lift system located pool side for emergency evacuation while continuing to supply air to the vehicle canopy. Thus, the pneumatic inflatable bladder 1504 and the source of compressed air 1502 allows the vehicle to change the from negatively buoyant to positively buoyant in the case of an emergency. The release of compressed gas into the pneumatic inflatable bladder(s) 1504 is controlled by an emergency valve 1506 accessible by staff. The positioning of the inflated bladder(s) assures a stable center of gravity while ascending to the surface, and provides sufficient positive buoyancy while at the surface of the water for guests to exit the vehicle without overturning. The compressed air cylinder affixed to the vehicle may also provide a source of air supply to the air engine in case of power failure or possible interruption of air supply through the embedded diffusers. Once the air supply within the compressed air cylinder is engaged, the compressed air cylinder will deliver a calibrated flow of air to the air engine thru the use of a regulator and air calibration valve sufficient to return the vehicle to the carousel.

While the foregoing written description of the invention enables one of ordinary skill to make and use an underwater park ride system that includes an underwater vehicle as described above, those of ordinary skill will understand and appreciate the existence of variations, combinations, and equivalents of the described embodiments, methods, and examples herein. Thus, the invention as claimed should therefore not be limited by the above described embodiments, methods, and examples, but by all embodiments and methods within the scope and spirit of the claimed invention.

The claimed invention is:

1. An entertainment system, comprising:

a track having a plurality of air registers embedded within the track for discharging compressed air; and an underwater vehicle having an air engine that is configured to collect the discharged compressed air in a manner that propels the underwater vehicle along the track.

2. The entertainment system recited in claim 1, wherein the air engine comprises one or more air rotors operative to capture the discharged compressed air and to convert the discharged compressed air to mechanical power to propel the underwater vehicle.

3. The entertainment system recited in claim 2, wherein the underwater vehicle further includes a drive wheel that is driven in response to the rotation of the air rotor.

4. The entertainment system recited in claim 1, wherein the underwater vehicle further includes a plenum on an underside of the underwater vehicle that is configured to channel the discharged compressed air to the air engine.

5. The entertainment system recited in claim 1, wherein the underwater vehicle further includes a plenum on the underside of the vehicle that is configured to channel a portion of the discharged compressed air into a canopy for guests to breath.

6. The entertainment system recited in claim 5, wherein the canopy is configured to pivot and lock between at least two positions, wherein one position represents a closed position and another position represents an open position.

7. The entertainment system recited in claim 6, wherein the underwater vehicle further comprises at least one adjustable seat, wherein the at least one adjustable seat is affixed to the underwater vehicle below the canopy.

8. The entertainment system recited in claim 7, wherein the underwater vehicle further includes an upward sloped foot bed configured to aid in securing the guest within their seat and to comfortably provide additional stability to counter the minimally negative buoyancy of the guest when under water.

9. The entertainment system recited in claim 5, wherein the canopy comprises a radio communication system with antenna extended above the waters surface to transmit information into and out of the vehicle.

10. The entertainment system recited in claim 5, wherein the displaced air within the canopy is exhausted through vents located at the rear of the canopy to direct the exhausted bubbles away from the forward and side facing view of the guests through a canopy viewing window.

11. The entertainment system recited in claim 1, wherein an inflatable pneumatic bladder is inflatable via a compressed air cylinder affixed to the underwater vehicle with sufficient air volume to raise the underwater vehicle to the surface of the water in case of at least one of a mechanical breakdown occurs and an emergency procedure is needed.

12. The entertainment system recited in claim 1, wherein a cylinder of compressed air is secured within the underwater vehicle with its contents being readily available for a measured release of air for guests within the underwater vehicle.

13. An entertainment system, comprising: a underwater course comprising a plurality of tracks having a plurality of air registers embedded within each track for discharging compressed air, the underwater course being in a water environment; an underwater vehicle having an air engine that is configured to collect the discharged compressed air in a manner that propels the underwater vehicle along the course; and an ascending conveyor system for transitioning the underwater vehicle out of the water environment onto a loading and unloading conveyor which will return the vehicle into the water environment.

14. The entertainment system recited in claim 13, wherein the water environment includes a pool filled with water and a plurality of themed features.

15. The entertainment system recited in claim 13, wherein the plurality of air registers are configured to adjust a flow of air supply to the vehicle and are located among the plurality of tracks thereby varying the speed of the underwater vehicle as the underwater vehicle is propelled along the course.

16. The entertainment system recited in claim 13, wherein the underwater vehicle includes a steering mechanism that allows lateral movement along the plurality of tracks.

17. The entertainment system recited in claim 16, wherein the plurality of tracks are configured with sloping sides to keep the underwater vehicle contained with the underwater course.

18. The entertainment system recited in claim 17, wherein the underwater vehicle includes guide wheels configured in concert with two front drive wheels that are configured to self-steer the vehicle whenever the guide wheels contact side walls of the track.

19. An underwater vehicle, comprising:

an air engine that is configured to collect discharged compressed air in a manner to propel the underwater vehicle along an underwater course; and a canopy configured to provide a breathing air space for one or more guests, wherein the discharged compressed air is collected by a vehicle plenum and fed into a container that when being filled with air releases a controlled discharge of compressed air into the canopy.

20. The underwater vehicle recited in claim 19, wherein the air engine comprises an air wheel operative to capture the discharged compressed air and to convert the discharged compressed air to mechanical power to propel the underwater vehicle.

21. The underwater vehicle recited in claim 19, further comprising a plenum on an underside of the underwater vehicle that is configured to channel the discharged compressed air to the air engine.

22. The underwater vehicle recited in claim 19, further comprising a drive wheel that is driven in response to a rotation of an air rotor.

23. The underwater vehicle recited in claim 19, further comprising an adjustable seat configured to adjust the height of the one or more guests within the canopy in a manner such that the shoulder height of each guest within the canopy is approximately the same.

* * * * *